US008876099B2

(12) United States Patent
Guaraldi

(10) Patent No.: US 8,876,099 B2
(45) Date of Patent: Nov. 4, 2014

(54) PROFILED CHAIN TOPS FOR A CONVEYOR

(75) Inventor: Glenn Alan Guaraldi, Kingston, NH (US)

(73) Assignee: Goss International Americas, Inc., Durham, NH (US)

( * ) Notice: Subject to any disclaimer, the term of this patent is extended or adjusted under 35 U.S.C. 154(b) by 1383 days.

(21) Appl. No.: 12/290,618

(22) Filed: Oct. 31, 2008

(65) Prior Publication Data

US 2010/0109224 A1 May 6, 2010

(51) Int. Cl.
*B65H 5/32* (2006.01)

(52) U.S. Cl.
CPC ..... *B65H 5/32* (2013.01); *B65H 2701/1932* (2013.01)
USPC ..... 270/52.26; 270/52.14; 270/52.16

(58) Field of Classification Search
USPC ..... 270/52.14, 52.16, 52.17, 52.18, 52.19, 270/52.26, 52.29
See application file for complete search history.

(56) References Cited

U.S. PATENT DOCUMENTS

| | | | | |
|---|---|---|---|---|
| 1,601,802 | A | | 10/1926 | Kast |
| 3,744,211 | A | | 7/1973 | Titchenal et al. |
| 3,807,547 | A | | 4/1974 | Mueller |
| 5,324,014 | A | | 6/1994 | Honegger et al. |
| 5,375,824 | A | * | 12/1994 | Anker et al. ..... 270/52.29 |
| 5,685,533 | A | * | 11/1997 | Hartsoe ..... 271/11 |
| 5,820,325 | A | | 10/1998 | Hartsoe |
| 5,853,081 | A | * | 12/1998 | Hastie ..... 198/644 |
| 6,142,354 | A | | 11/2000 | Boss et al. |
| 6,581,753 | B1 | | 6/2003 | Brewster et al. |
| 7,281,706 | B2 | * | 10/2007 | Kinne et al. ..... 270/52.16 |
| 7,762,538 | B2 | | 7/2010 | Kinne et al. |
| 2005/0285319 | A1 | | 12/2005 | Lee |
| 2007/0216080 | A1 | | 9/2007 | Kinne et al. |

FOREIGN PATENT DOCUMENTS

| | | |
|---|---|---|
| EP | 1 074 495 | 2/2001 |
| EP | 1566284 A2 | 8/2005 |
| EP | 1939008 A2 | 7/2008 |

* cited by examiner

*Primary Examiner* — Leslie A Nicholson, III
(74) *Attorney, Agent, or Firm* — Davidson, Davidson & Kappel, LLC

(57) ABSTRACT

A saddle stitcher for conveying a printed product is provided. The saddle stitcher includes a saddle chain conveyor, and a plurality of chain tops mounted on the saddle chain conveyor defining a chain top conveyance line for transporting a printed product. At least one of the chain tops includes a profiled top edge so the at least one chain top does not extend beyond the chain top conveyance line in a transition area. A method for transferring a printed product is also provided.

18 Claims, 7 Drawing Sheets

PROFILED CHAIN TOPS FOR A CONVEYOR

BACKGROUND

The present invention relates generally to printing presses and more particularly to chains for conveying printed products.

U.S. Pat. No. 3,807,547 discloses a pair of endless parallel conveyor chains that have respective upper horizontal runs on which paper sheets are to be conveyed towards a discharge location. Each of the chains is composed of an endless series of roller links and elements which are fastened thereto. The upper or outer ends of the elements are angled towards one another and define a roof-shaped surface for supporting the folded sheets which are placed onto the chains.

U.S. Pat. No. 5,375,824 discloses a binding line including a first bind line section for transporting signatures seriatim therealong to a book exit end. A second binding line section transports signatures seriatim therealong to a book entry end. A transfer section transfers signatures seriatim from the first binding line section exit end to the second binding line section entry end. The first and second binding line sections are synchronously driven so that both the first and second binding line sections operate at a constant signature feed rate. The first binding line section provides a different spacing between successive signatures than does the second binding line section. The first and second binding line sections are driven at different velocities to provide the constant feed rates.

U.S. Pat. No. 5,685,533 discloses a double lug conveyor chain. The double lugs convey the book form through the stitcher station where the book form is stitched and then delivers the book form to the trimmer infeed conveyor which carries the book form now stitched directly into the trimmer machine for trimming the book form.

U.S. Publication No. 2007/0216080 discloses driver elements and a corresponding saddle chain. An endless saddle chain which can be used in a saddle stitcher includes saddle segments and receiver segments. Chain segments are disposed between the saddle segments and the receiver segments which are conventional for saddle chains. The saddle segments of the saddle chain have a roof and the saddle segments of the saddle chain in their entirety form a substantially continuous saddle.

EP 1 074 495 discloses a conveyor for collecting together and/or assembling printed sheets including an endless flexible track which has a saddle-shaped supporting surface and is fitted with carriers between which each sheet fits. The carriers can be moved from a position where they are above the conveyor to a position where they extend sideways.

BRIEF SUMMARY OF THE INVENTION

The present invention provides a saddle stitcher for conveying a printed product. The saddle stitcher includes a saddle chain conveyor and a plurality of chain tops mounted on the saddle chain conveyor defining a chain top conveyance line for transporting a printed product. At least one of the chain tops includes a profiled top edge so the at least one chain top does not extend beyond the chain top conveyance line in a transition area.

The present invention also provides a method of transferring a printed product. The method includes the steps of conveying a printed product on a saddle chain conveyor, the saddle chain conveyor including a plurality of chain tops defining a chain top conveyance line and transferring the printed product from the saddle chain conveyor to a further transport system. At least one of the plurality of chain tops includes a profiled top edge for transfer of the printed product, the profiled edge remains under the chain top conveyance line in the transition area.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Figure 1:
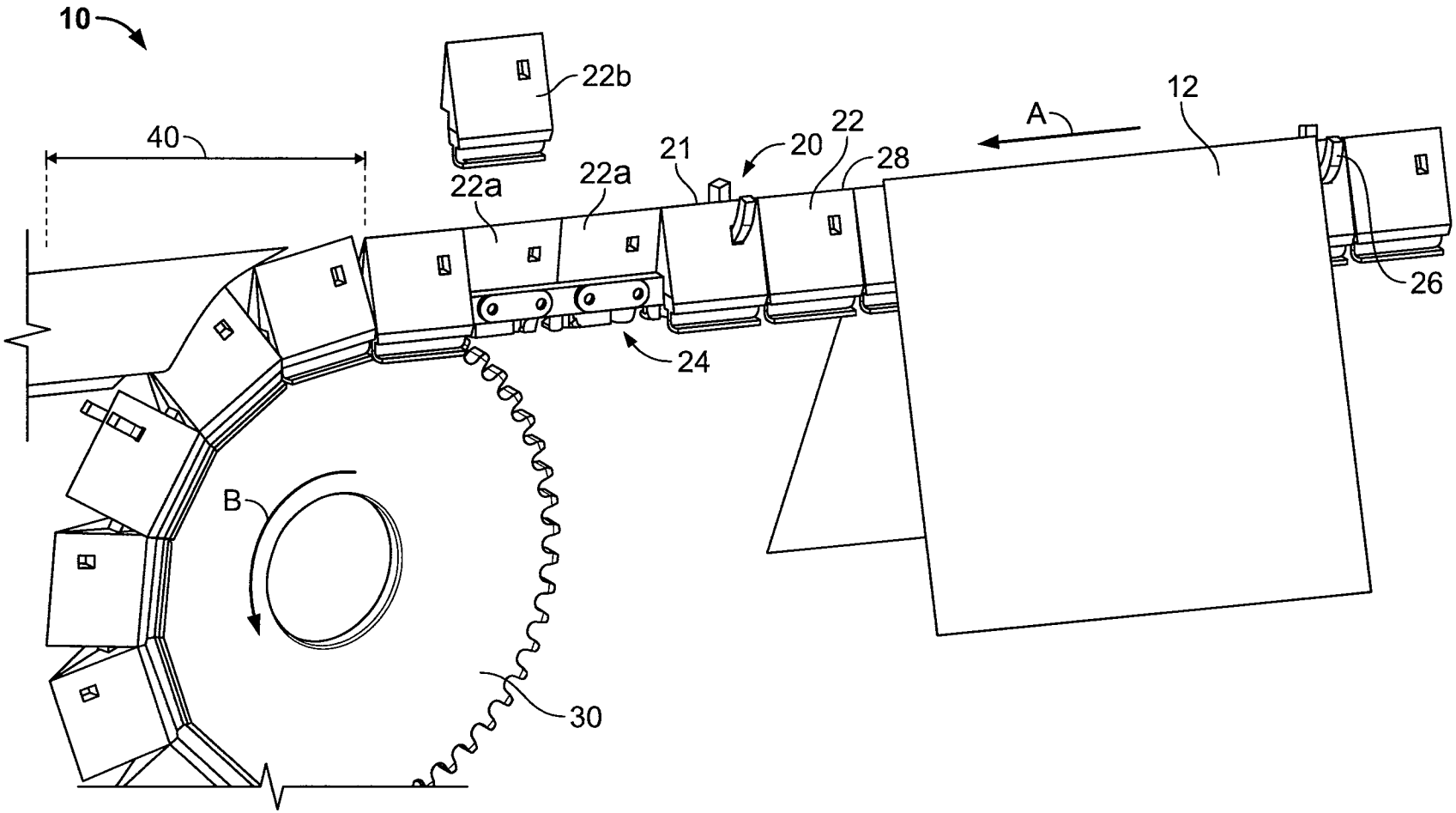
FIG. 1 (Prior Art)
FIG. 1 shows a signature being transported on a saddle stitcher chain in accordance with the prior art.

FIG. 1 shows a prior art saddle stitcher chain 10. The saddle stitcher chain 10 includes an endless chain 20. Endless chain 20 includes chain tops 22 mounted on chain links 24. Chain tops 22 include two halves 22*a*, 22*b* that are fastened together and snap onto chain links 24. A chain pin 26 is provided to register and transport a printed product, for example, a book 12, on endless chain 20 in a direction A. Top edges 21 of chain tops 22 form a chain top conveyance line 28 on which book 12 is conveyed.

Figure 2:
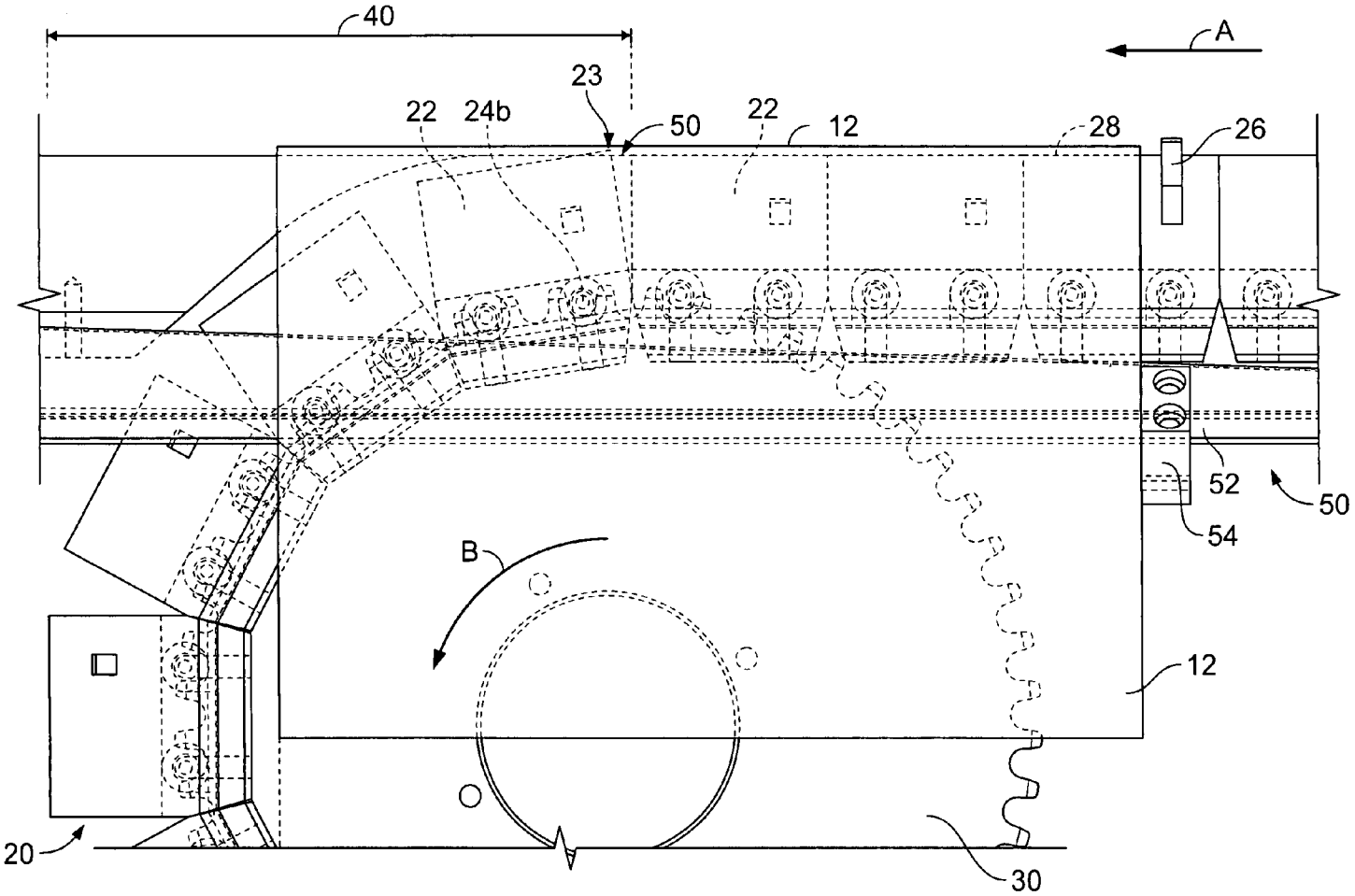
FIG. 2 (Prior Art)
FIG. 2 shows the prior art signature and saddle stitcher chain of FIG. 1.

A sprocket 30 drives endless chain 20 in a counter-clockwise direction B. Book 12 is transported in direction A until book 12 reaches a transition area 40 where a second transport system 50 conveys book 12 further downstream, as shown in FIG. 2. The second transport system 50 may be, for example, an overhead system or an adjacent system. A second transport system is disclosed in U.S. Publication 2005/0285319, hereby incorporated by reference herein.

Second transport system 50 includes an endless belt 52 which has drive lugs 54 fastened at regular intervals. Drive lugs 54 travel in direction A at a higher velocity than endless chain 20. As drive lugs 54 approach and contact books 12, second transport system 50 takes over transporting books 12 downstream. As shown by book 12, drive lug 54 has contacted and accelerated book 12 away from drive pin 26 and transports book 12 further downstream via second transport system 50. At transition area 40 chain links 24, chain tops 22 and chain pin 26 enter a chain return path. Chain links 24, chain tops 22 and chain pin 26 rotate downward and around sprocket 30 in direction B.

As chain tops 22 sequentially engage sprocket 30, a trailing tip 23 of each chain top 22 rises above chain top conveyance line 28 and lifts book 12 at the point of contact. As each subsequent chain top 22 circulates around sprocket 30, book 12 is raised then lowered at each point of contact causing book 12 to rock up and down. The jostling of book 12 may be detrimental to the smooth transport through transition area 40. If transport is stopped temporarily with book 12 in a lifted position, pages of book 12 may splay or slide forward resulting in a book that may need to be discarded. Another disruption of book 12 may occur during transport in transition area 40. Chain top 22 rotates downward about chain link 24*b* in the chain return path. As this rotation occurs, a trailing surface 29 of chain top 22 crosses a plane 27 of chain top 22 as shown in FIG. 3.

Figure 3:
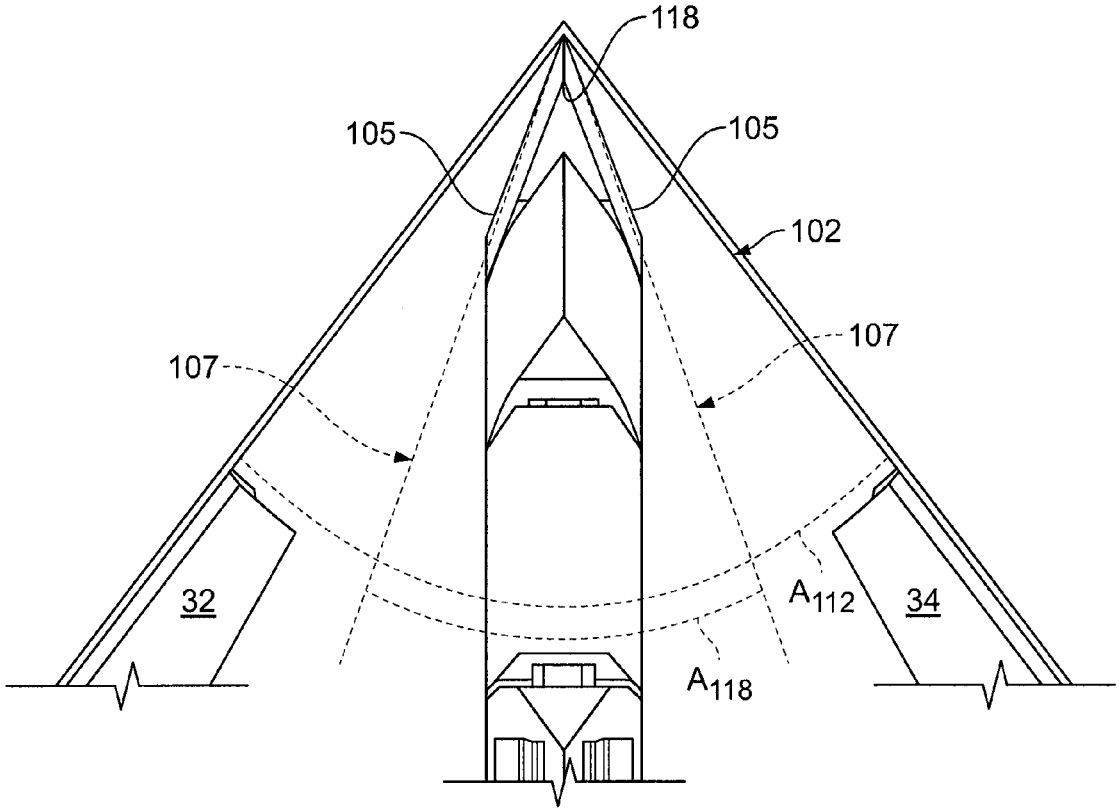
FIG. 3 shows a plurality of chain tops in a transition area.

In FIG. 3, a rear tip of chain tops 118 has been removed that would otherwise disrupt book 102 in accordance with a preferred embodiment of the present invention. However, book 102 may still be disrupted as chain tops 118 travel around the sprocket. If book 102 is resting on chain top 118, book 102 is open to an angle $A_{118}$ of chain top 118. Book 118 may be disrupted when trailing surface 105 breaks plane 107. As shown in FIG. 3, trailing surface 105 is above plane 107, thus breaking plane 107. Paper guides 32, 34 may be used to support book 12 so book angle $A_{102}$ is sufficiently greater than chain top angle $A_{118}$. When paper supports 32, 34 are used, trailing surface 105 may extend beyond a plane 107 of chain top 118, but remains under book 102 so trailing surface 105 does not disrupt book 102.

Figure 4:
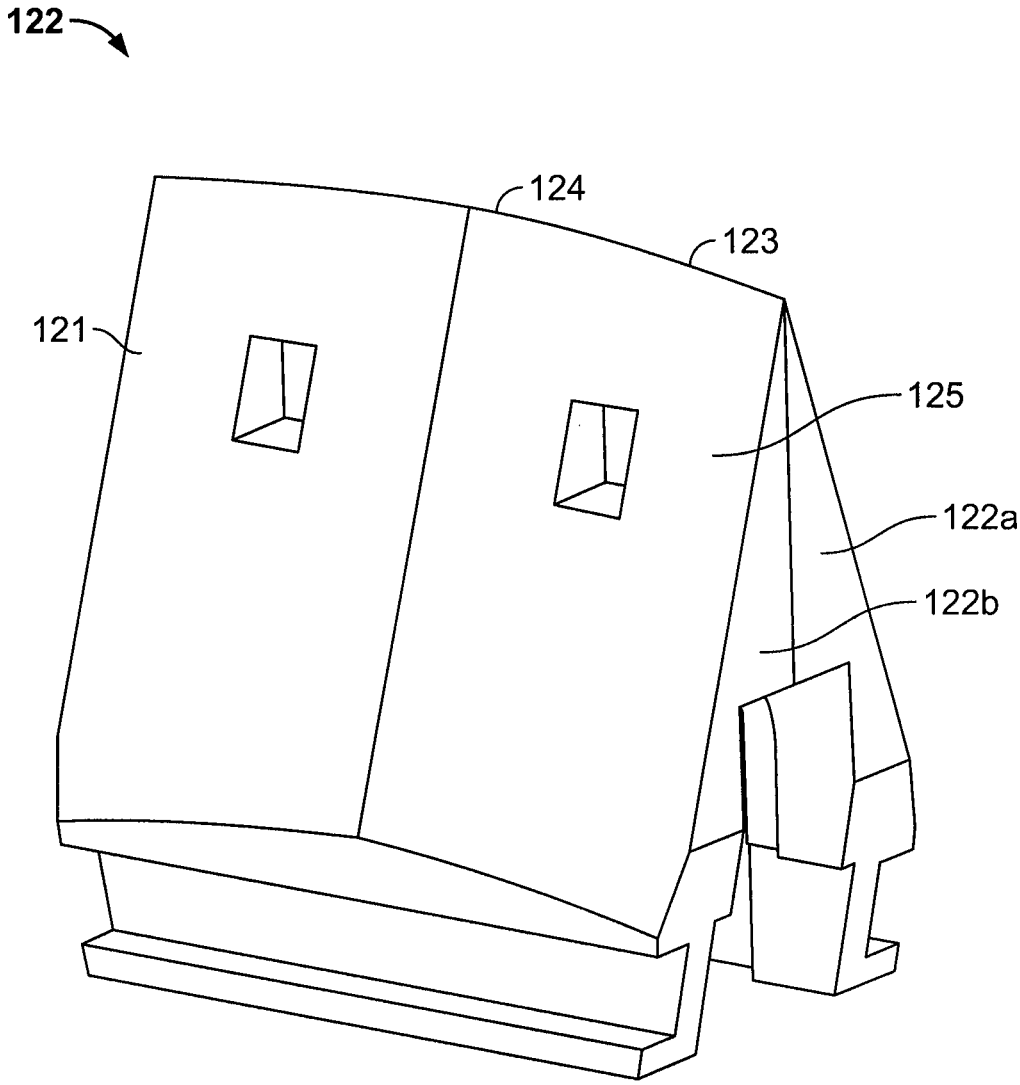
FIGS. 4 and 5 show preferred embodiments of a profiled chain top in accordance with the present invention.
Figure 5:
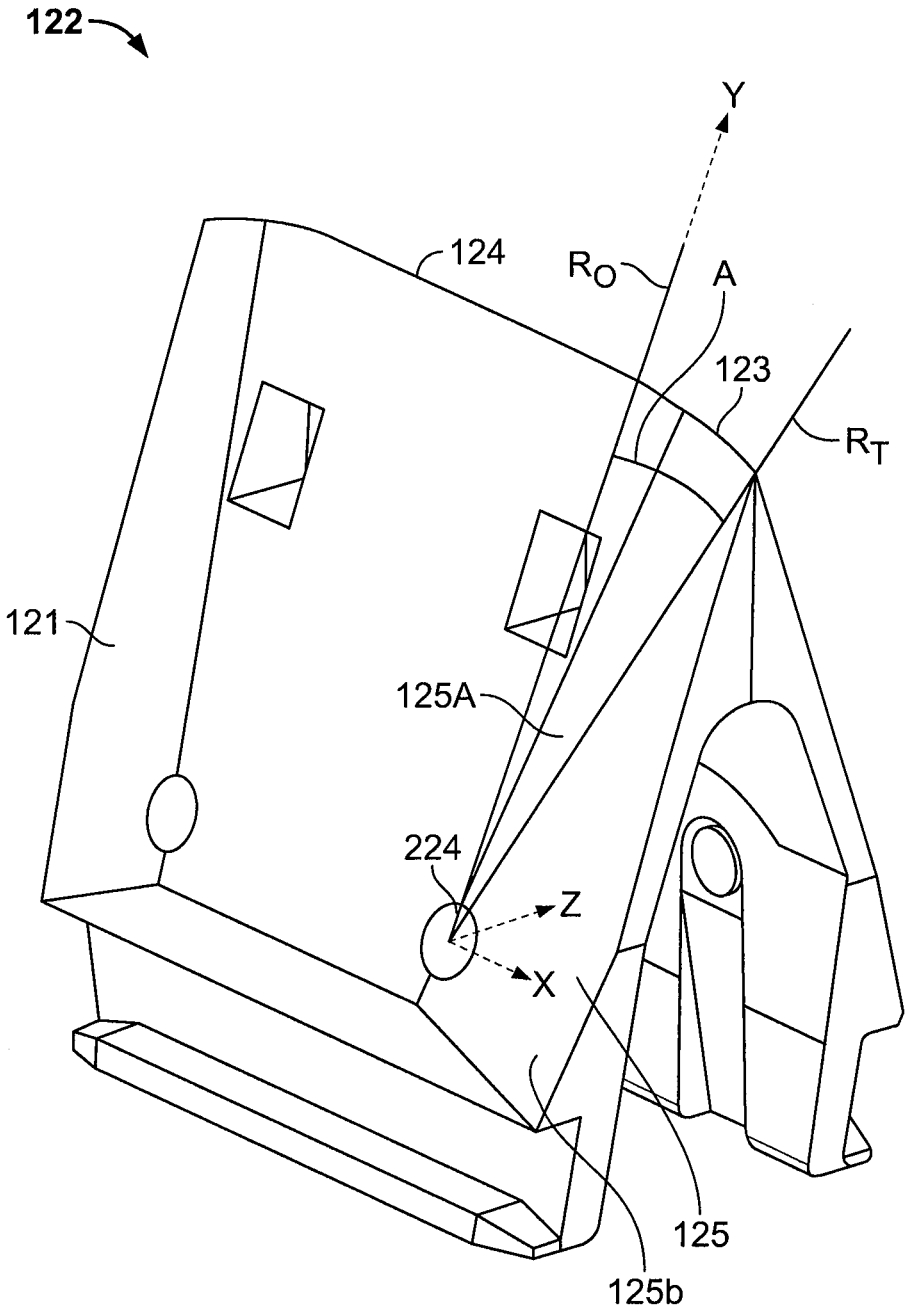
Figure 6:
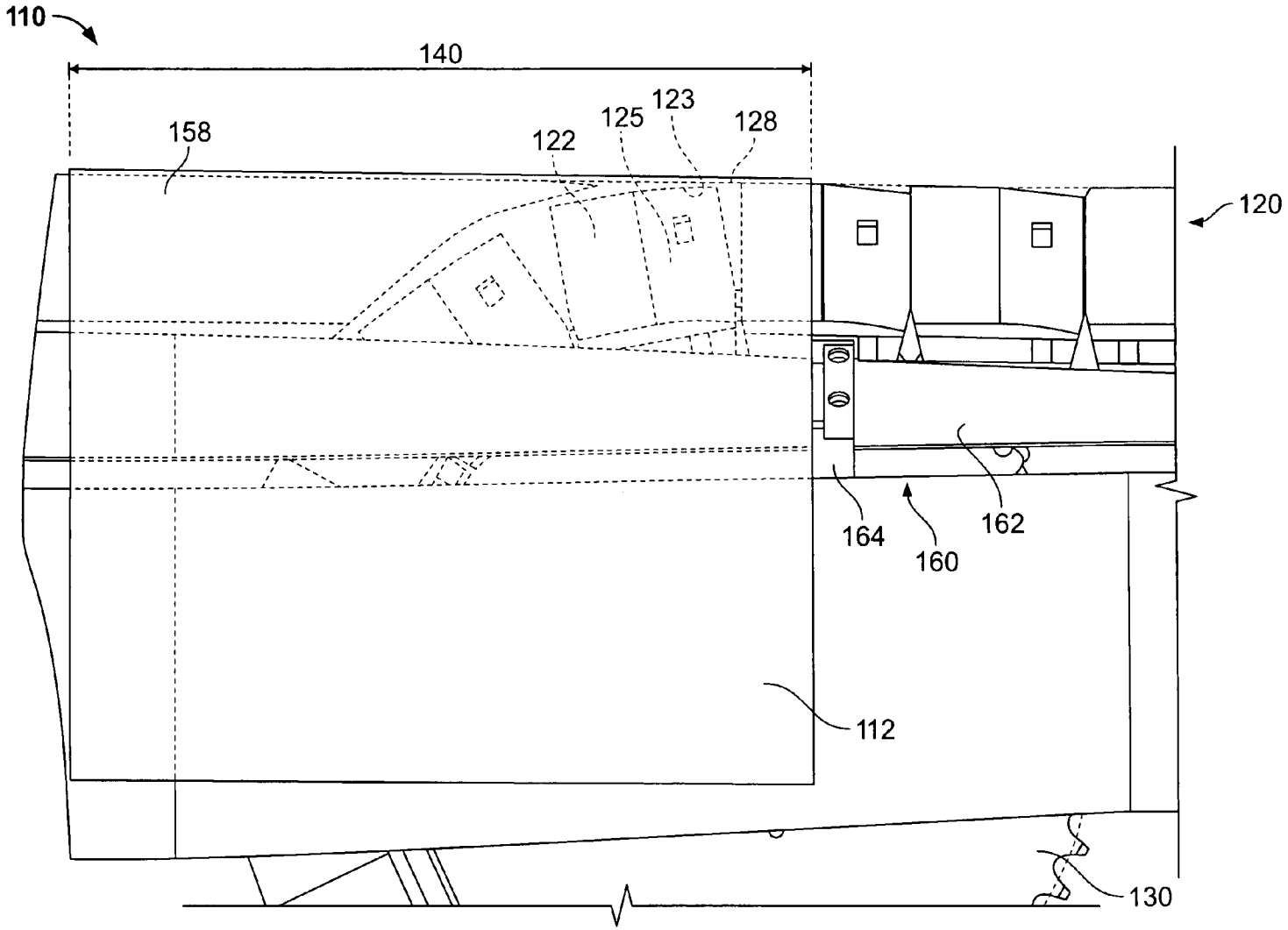
FIG. 6 shows an embodiment of a saddle stitcher chain in accordance with the present invention.

FIGS. 4, 5 and 6 show a profiled chain top 122 in accordance with a more preferred embodiment of the present invention. Chain top 122 is preferably made of two halves 122*a*, 122*b* which may be fastened together and snap over chain links via chain link slots 224 on an endless chain. Chain top halves 122*a*, 122*b* may be mirror images of each other. Top edge 124 of chain top 122 is curved downward across a trailing tip 123 so trailing tip 123 does not rise above a conveyance line 128 and knock, lift or contact a book 112. See FIG. 6.

A face of chain top 122 includes a leading surface 121 and a trailing surface 125. Trailing surface 125 is modified to maintain an edge as trailing tip 123 curves down, otherwise removing a portion of trailing tip 123 would result in an exposed flat surface, not an edge desirable for transporting a book. A reference line $R_0$ is created on the surface of chain top 122 from a center of chain link slot 224 extending in a direction y past top edge 124. Reference line $R_0$ is then rotated until reference line reaches a corner of trailing tip 123 represented by reference line $R_T$. Reference line $R_0$ and reference line $R_T$ define an angle of rotation A. The angle of rotation A, may be, for example, approximately 22.5° and may vary depending upon the size and shape of chain top 122 and length of trailing tip 123. Using the rotated reference line $R_T$ a trim plane is created tangent to the radial surface and perpendicular to the resulting face. The surface of chain top 122 may be trimmed so trailing surface 125 has a convex surface across an area 125*a* and a linear surface across an area 125*b*. Trailing surface 125 provides an edge along trailing tip 123 and a trailing surface 125 that does not break a plane of book 112 when an angle of book 112 corresponds to an angle of chain top 122. It may be advantageous for leading surface 121 to be manufactured similarly to trailing surface 125, although it is not necessary for performance.

FIG. 6 shows a saddle stitcher chain 110 in accordance with a preferred embodiment of the present invention. A plurality of chain tops 122 are mounted on endless chain 120 to form a chain top conveyance line 128. A second transport system 160 includes drive lugs 164 and an endless belt 162. A second transport system is disclosed in U.S. Publication 2005/0285319, hereby incorporated by reference herein. The second transport system may be, for example, an overhead or an adjacent system. Chain tops 122 transport a book 112 from saddle stitcher chain 110 to book guide 158 via second transport system 160 without disruption as profiled chain tops 122 enter transition area 140, engage sprocket 130 and rotate downward into a chain return path. As shown in FIG. 6, trailing tip 123 of chain top 122 does not extend past chain top conveyance line 128 or contact book 112 at a spine of the book. Trailing surface 125 remains within the chain top angle (see FIG. 3) and also does not disrupt book 112 in the transition area during transfer.

Figure 7:
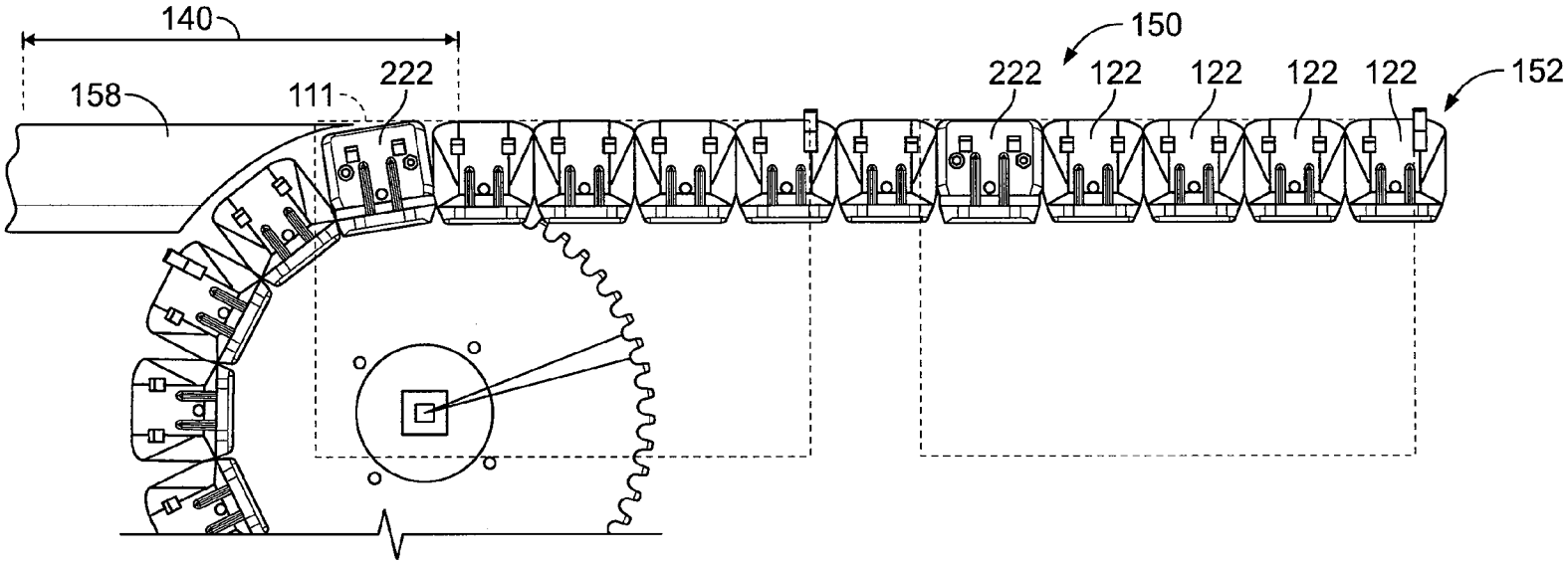
FIG. 7 shows a further embodiment of a saddle stitcher chain in accordance with the present invention.
Figure 8:
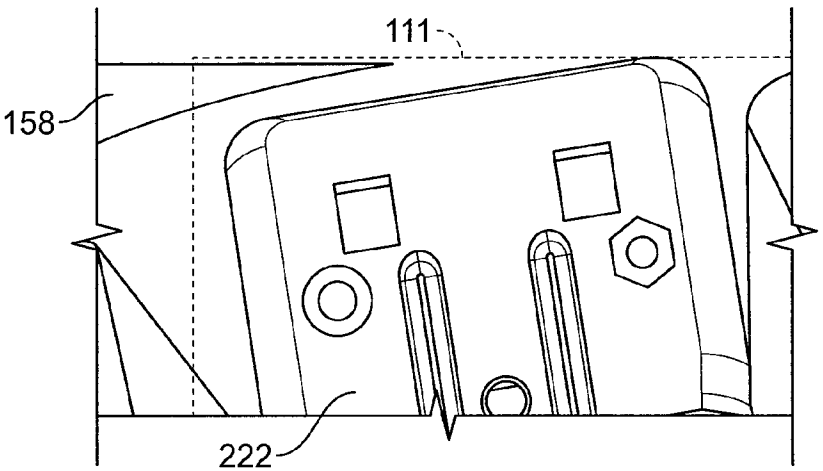
FIG. 8 shows a squared chain top shown in the saddle stitcher chain in FIG. 7.

FIG. 7 shows a further preferred embodiment of a saddle stitcher chain 150 in accordance with the present invention. Saddle stitcher chain 150 includes a plurality of chain tops 122 and squared chain tops 222. Squared chain tops 222 are shown in more detail in FIG. 8. Squared chain tops 222 dispersed amongst profiled chain tops 122 may be advantageous for controlled lifting of printed products 112. Squared chain tops 222 may be placed on endless chain 152 so squared chain tops 222 lift a leading edge 111 of book 112 in transition area 140. Lifting leading edge 111 assists in a successful transition of book 112 from endless chain 152 to paper guide 158. Squared chain tops 222 and profiled chain tops 122 may be replaced or rearranged to accommodate varying book lengths and cutoffs.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A saddle stitcher for conveying a printed product comprising:

a saddle chain conveyor;

a plurality of chain tops mounted on the saddle chain conveyor defining a chain top conveyance line for transporting a printed product, at least one of the chain tops including a profiled top edge so the at least one chain top does not extend beyond the chain top conveyance line in a transition area; and a chain pin for registering a printed product on the saddle chain conveyor.

2. The saddle stitcher as recited in claim 1 wherein at least one of the chain tops does not include the profiled top edge.

3. The saddle stitcher as recited in claim 2 wherein a position of the at least one profiled chain top in the conveyance line is variable.

4. The saddle stitcher as recited in claim 1 wherein the at least one profiled chain top includes a trailing surface that remains within a plane of the chain top in the transition area.

5. The saddle stitcher as recited in claim 4 wherein the trailing surface includes a convex surface.

6. The saddle stitcher as recited in claim 4 wherein the trailing surface includes a linear surface.

7. The saddle stitcher as recited in claim 4 wherein the trailing surface does not disrupt the book in the transition area during a transfer.

8. The saddle stitcher as recited in claim 1 further comprising a sprocket, the saddle chain conveyor rotating around the sprocket.

9. The saddle stitcher as recited in claim 1 further comprising a second transport system for transporting the printed product further downstream.

10. The saddle stitcher as recited in claim 9 wherein the second transport system includes a book guide.

11. The saddle stitcher as recited in claim 9 wherein the second transport system accelerates the printed product in the transition area.

12. The saddle stitcher as recited in claim 1 wherein the profiled top edge is curved downward along a trailing tip of the chain top.

13. The saddle stitcher as recited in claim 1 wherein the chain top conveyance line is defined by a line formed between two adjacent chain top edges of two adjacent chain tops, prior to rotation of either adjacent chain top in the transition area.

14. The saddle stitcher as recited in claim 1 wherein the chain top is composed of two halves fastened together.

15. The saddle stitcher as recited in claim 1 wherein the profiled top edge does not contact a spine of the book in the transition area.

16. A method of transferring a printed product comprising the steps of:

conveying a printed product on a saddle chain conveyor, the saddle chain conveyor including a plurality of chain tops defining a chain top conveyance line;

transferring the printed product from the saddle chain conveyor to a further transport system, at least one of the plurality of chain tops including a profiled top edge for transfer of the printed product, the profiled edge remaining under the chain top conveyance line in the transition area; and lifting a printed product during transfer using at least one chain top that does not include a profiled top edge.

17. The method as recited in claim 16 wherein during the step of transferring the profiled chain top includes a trailing surface that remains within a plane of the chain top during transfer.

18. A saddle stitcher for conveying a printed product comprising:

a saddle chain conveyor;

a plurality of chain tops mounted on the saddle chain conveyor defining a chain top conveyance line for transporting a printed product, at least one of the chain tops including a profiled top edge so the at least one chain top does not extend beyond the chain top conveyance line in a transition area; and a second transport system for transporting the printed product further downstream, wherein the second transport conveyor is an adjacent saddle conveyor.

* * * * *